Fig.1.
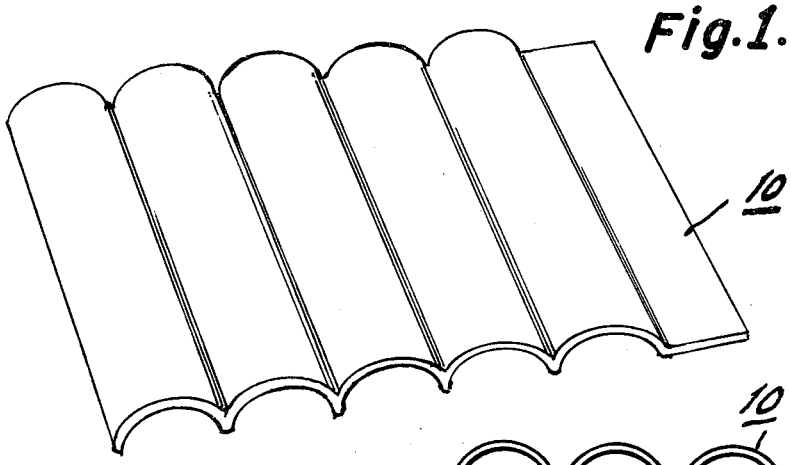
Fig.2.
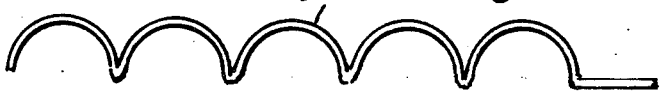
Fig.3.
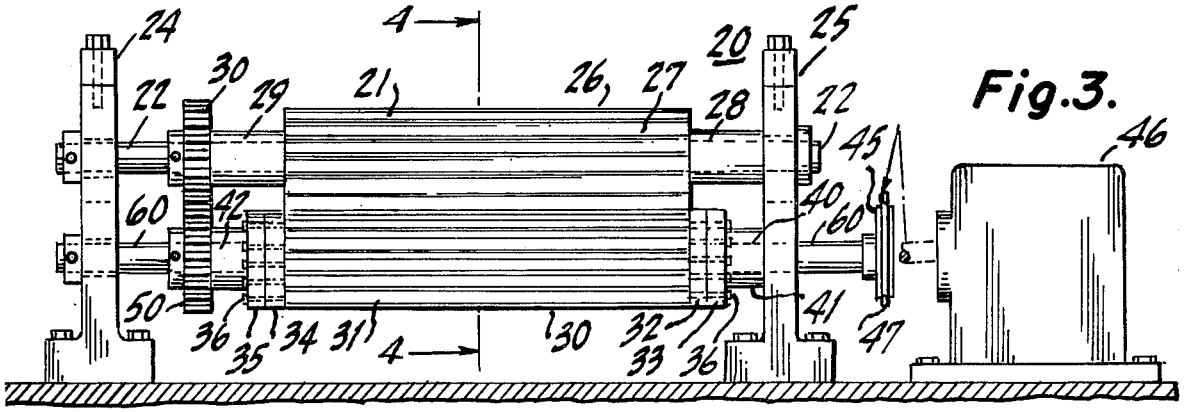
Fig.5.
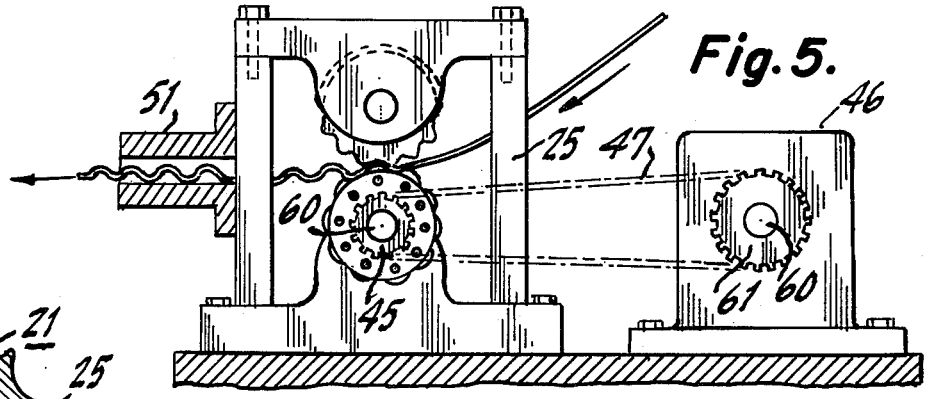
Fig.4.
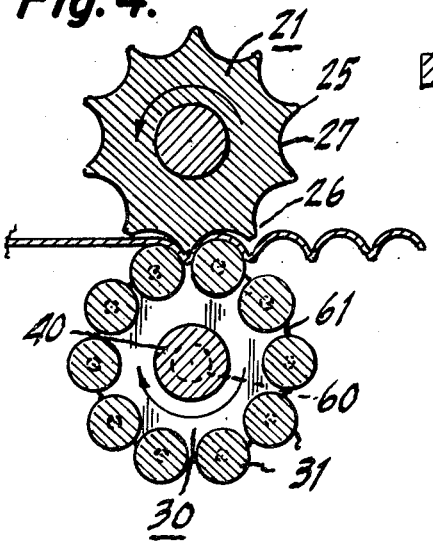
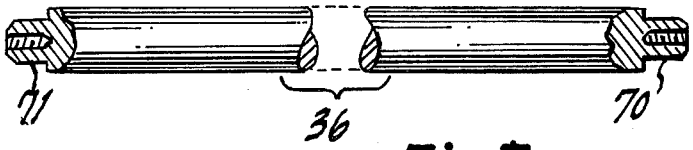
Fig.7.

United States Patent [19]

Culina et al.

[11] 4,179,912

[45] Dec. 25, 1979

[54] APPARATUS AND METHODS FOR FORMING PANELS HAVING SCALLOPED CROSS-SECTIONS

[76] Inventors: William Culina, R.D. # 1, Box 74-A, Champion, Pa. 15622; Charles Klus, 204 S. 6th St., Lowber, Pa. 15697

[21] Appl. No.: 891,150

[22] Filed: Mar. 28, 1978

[51] Int. Cl.[2] ..... B21D 13/04

[52] U.S. Cl. ..... 72/196

[58] Field of Search ..... 72/196, Dig. 16

[56] References Cited

U.S. PATENT DOCUMENTS

| | | | |
|---|---|---|---|
| 626,183 | 5/1899 | Martin | 72/196 |
| 3,091,836 | 6/1963 | Thomas | 29/455LM |
| 3,394,573 | 7/1968 | Bodnar | 72/196 |

*Primary Examiner*—Lowell A. Larson
*Attorney, Agent, or Firm*—Arthur L. Plevy

[57] ABSTRACT

Cold working apparatus operates to form a metallic sheet panel of material into a panel having a scalloped cross-sectional configuration. A first roller assembly has a major surface of a gear-like configuration comprising a series of continuous arcuate projections and depressions. A second rod assembly comprises a plurality of rods of equal diameter positioned to form a cross-sectional circular array. The first roller and rod assembly are positioned proximate one another to allow insertion of the metal sheet between the roller and rod assemblies and means for rotating the assemblies with respect to one another to cause the surfaces of said assemblies to form the planar sheet into a panel having a scalloped cross-sectional configuration.

4 Claims, 7 Drawing Figures

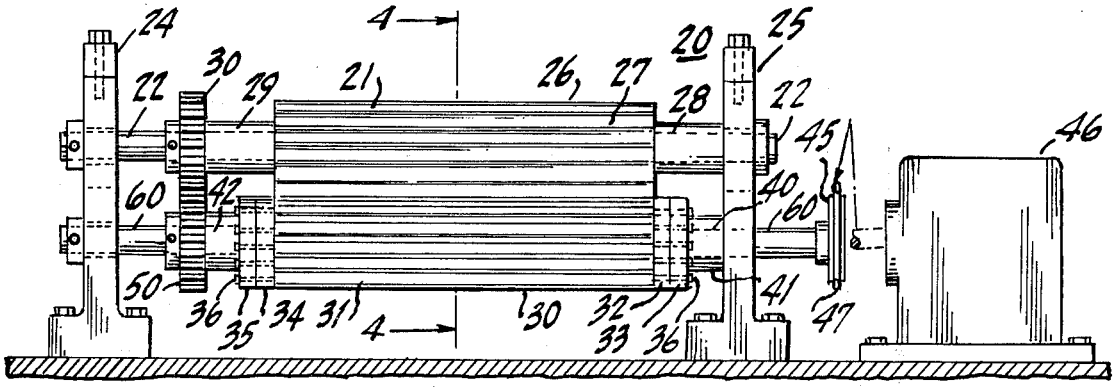

APPARATUS AND METHODS FOR FORMING PANELS HAVING SCALLOPED CROSS-SECTIONS

BACKGROUND OF INVENTION

This invention relates to panel forming apparatus and more particularly to apparatus for shaping or forming panels to assume a scalloped cross-sectional configuration.

There are many machines utilized in the metal processing industry which shape or otherwise preform metal sheet material into given configurations. Many techniques employ multiple rolling or forming procedures in order to operate on a metal sheet to preform the surface in a desired configuration. Many of these processes employ hot working which is defined as the plastic deformation of metals. In such techniques, ignots of metal such as steel are processed by means of rollers operating under high temperatures and forces. The rollers revolve in opposite directions and operate to squeeze and elongate metal. The process of hot rolling is well known and has been used in the steel industry for many years.

There are many cold working processors which also serve to form and shape metal. Thus, sheet metal can be bent at various angles by the use of dies in conjunction with the use of press brakes and these techniques are employed to form various angular configurations on a surface of a planar sheet of steel.

Another technique is referred to as cold roll forming and these techniques form complex sections by the progressive bending of strip metal as it passes through a series of forming rolls. A wide variety of shapes are formed by this process. Such machines as are used in the prior art employ a plurality of different rollers in order to finalize the desired shape. The techniques are expensive as the sheet product is cold rolled in gradual steps until the surface is formed according to a desired format.

There is a need for a simple and economical forming machine which can provide a scalloped surface configuration to a steel sheet by a simple and efficient process. Scalloped panels have great utility in the construction industry and may be employed in shutters, roofing, siding, and other applications where aesthetic qualities are important.

It is therefore an object of the present invention to provide apparatus for cold roll forming a sheet or panel of metal into a panel having a scalloped cross-sectional configuration and especially adapted for use in the building industry as above indicated.

BRIEF DESCRIPTION OF PREFERRED EMBODIMENT

A cold rolling apparatus for forming planar sheet material into panels having scalloped edge configurations comprising a first rotatable roller assembly manifesting a longitudinal cylindrical member having a major surface configuration consisting of continuous arcuate projections and depressions to thus form a gear-like appearance along a major portion of the length of said cylindrical member, a second rotatable rod assembly of a length relatively equal to said major portion of said first roller assembly and consisting of a plurality of rods of equal diameter symmetrically positioned about a central reference point to form a circular cross-sectional array with the spacing between said rods selected according to the width of said projections on said roller assembly, means for positioning said roller assembly with respect to said rod assembly such that the surfaces of said assemblies are located with respect to one another to enable insertion therebetween of said planar sheet, and drive means coupled to one of said assemblies for rotating the same with respect to said other assembly to cause said sheet as emplaced and directed through said assemblies to assume a scalloped edge configuration due to said surface configurations of said first roller and said second rod assemblies.

BRIEF DESCRIPTION OF THE FIGURES

FIG. 1 is a perspective view showing a panel formed by the apparatus according to this invention.

FIG. 2 is a side view or cross-sectional view of the panel shown in FIG. 1.

FIG. 3 is a front plan view of a forming apparatus according to this invention.

FIG. 4 is a cross-sectional view taken through line 4—4 of FIG. 3 depicting the nature of a top and a bottom roller assembly according to this invention.

FIG. 5 is a side plan view of the roller apparatus of FIG. 3.

FIG. 7 is a front schematic view depicting a typical rod assembly as employed in a bottom roller mechanism.

DETAILED DESCRIPTION OF INVENTION

Figure 6:
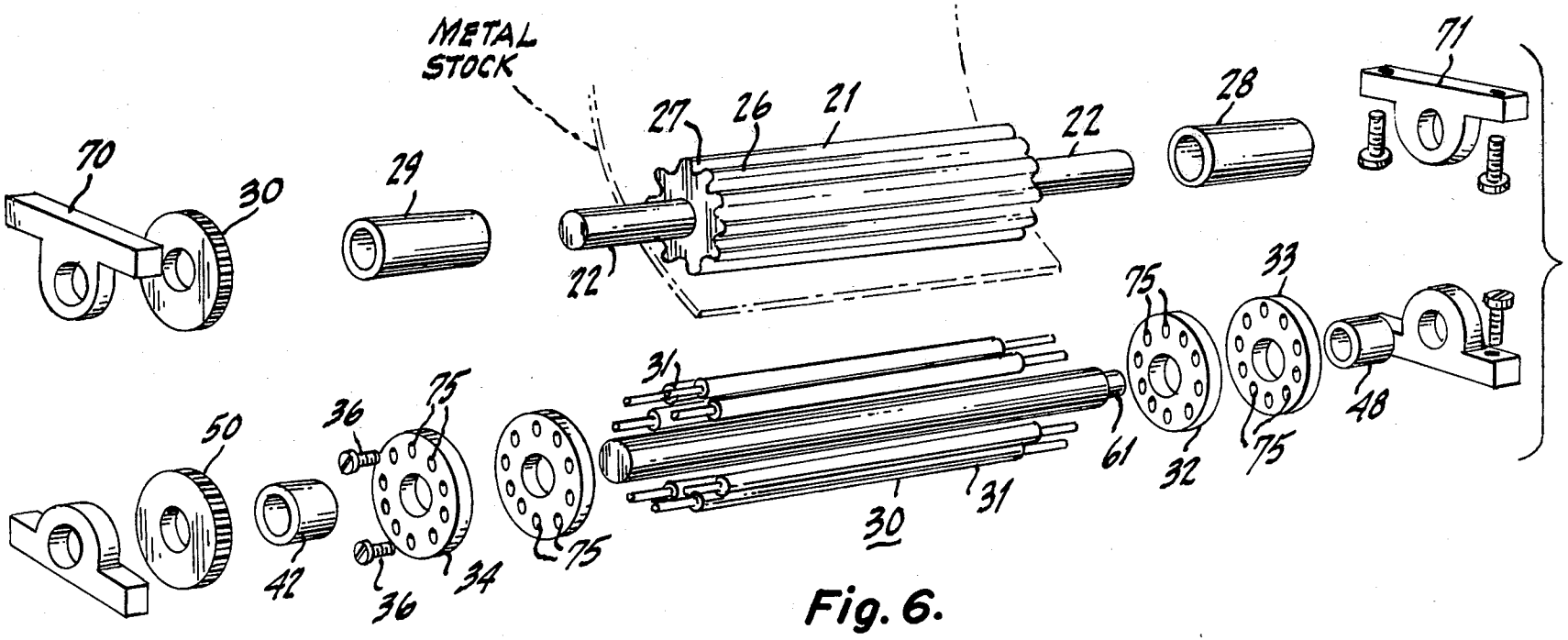
FIG. 6 is an assembly view showing the main components of the roller apparatus.

Referring to FIG. 1, there is shown a panel 10 which is formed by the apparatus to be described. As can be seen from the FIG., the panel has a top surface which includes a plurality of hemispherical areas, each of equal diameter and uniformly distributed across the surface of the panel. The panel appears scalloped from the side view as shown in FIG. 2 and essentially has a scalloped cross-sectional configuration.

The panel as shown in FIGS. 1 and 2 has great utility in the construction industry for use in shutters, roofing, siding, and so on. The surface of the panel presents a symmetrical and uniform appearance and is easy to maintain while providing aesthetic qualities due to the uniform nature of the surface configuration of the panel.

For an example of the use of panels such as 10 in construction and so on, reference is made to U.S. Pat. No. Des. 231,219 which issued on Apr. 9, 1974 to William Culina and Charles Klus, both of whom are inventors herein.

The fabrication of such panels as 10 having scalloped cross-sectional configurations is difficult as the prior art techniques require a plurality of different rolling steps to formulate the article having the configurations shown in FIGS. 1 and 2.

Referring to FIG. 3, there is shown a panel forming machine 20 which operates on sheet stock to provide a panel having the surface configuration described in FIGS. 1 and 2. Essentially, the machine consists of a top roller assembly 21 which is fabricated from a plastic or steel material. The roller assembly 21 is a unitary structure which possesses a surface configuration as shown in FIG. 4.

The roller 21 is rotatably mounted on a central shaft 22 which is rotatably coupled to left and right frame members 24 and 25. The roller 21 has a surface configuration as shown in FIG. 4 including a plurality of extending projections 26 which are arcuate in shape and straddle a circular depression 27 selected of a diameter and curvature according to the radius of the scalloped section to be formed.

The roller 21 is coupled to the frame member 25 by means of a bushing 28 which may be a ball bearing bushing and so on. The other end of the shaft 22 includes a gear 30 which as will be explained, is driven to cause the roller 21 to rotate.

Underlying roller 21 is a circular rod assembly 30. The assembly 30 consists of a plurality of rods 31. Each rod is firmly secured in position with respect to two circular end plates as 32 and 33 at the right side and 34 and 35 at the left side. The end plates contain a plurality of equally spaced apertures into which the rods are inserted and then bolted in position by means of suitable bolts as 36, as will be explained. The rod assembly 30 is rotatably mounted to the frame at both ends and as seen in the FIG., is located beneath the roller assembly 21 and as clearly depicted in FIG. 4.

The rod assembly 30 has a central shaft 40 which is rotatably mounted at both ends to the frame assembly through suitable bushings as 41 and 42. The rod 40 extends beyond the frame member 25 where it is coupled to a gear assembly 45. As will be explained, the gear assembly 45 is coupled to a motor 46 by means of a sprocket chain 46 or other suitable drive assembly to enable the rotation of the rod assembly 30.

The left side of the shaft 40 has a gear 50 located thereon. The gear 50 coacts with the gear 30 and hence, as gear 50 rotates when driven, gear 30 is rotated in the opposite direction. In this manner, the roller assembly 21 is rotated opposite to the rotation of the rod assembly 31. This operation is depicted in FIG. 4 by reference to the associated arrows depicting the respective rotation of assemblies 30 and 31.

Referring to FIG. 5, there is shown a side view of the apparatus of FIG. 3 in order to show the drive mechanism. Essentially, the motor 46 has a drive shaft 60 which is coupled to a suitable gear 61. As is known, in order to achieve a desired amount of power or driving force at a given speed, the motor may employ a gear reduction box to enable efficient coupling of the drive shaft 60 to the gear 45 coupled to the shaft 40 of the rod assembly 30.

As can be seen from FIG. 3, a sheet of metal 50 such as aluminum, steel and so on is inserted between the roller 21 and the rod assembly 30 and is formed at the output into the scalloped configuration. Also shown at the output is a guide mechanism 51 which directs the formed sheet to a production site where it may be rolled into a spool or otherwise stored.

Essentially, the apparatus thus described is capable of providing the structures shown in FIGS. 1 and 2 by a single rolling operation as performed by the above described apparatus. It is, of course, apparent that any size sheet can be accommodated by the apparatus as the length of the rollers can vary accordingly. Typical sheets which can be employed vary widely in thickness and such sheets as $1\frac{3}{8}''$ stock can easily be accommodated by the above described apparatus.

Referring again to FIG. 4, there is shown a cross-sectional view of the upper roller 21 positioned with respect to the rod assembly 30. As indicated, the rod assembly 30 consists of a plurality of equal diameter rods which are spaced about a central rod 60. Each rod as 31 is of the same diameter and is fabricated from a steel or other suitable material. As can be seen from FIG. 4, the roller member 21 has extending teeth or gear-like projections 26 which intermesh between space 61 formed between two adjacent rods as 30. The sheet material is directed between the space between roller 21 and the rod assembly 30 as shown in FIG. 4. The depressions in the roller assembly 21 have a surface shape to coact with the circular portion of the rod 31 to thus shape the metal according to the scalloped configuration.

As depicted in FIG. 4, the upper roller 21 is caused to rotate in the opposite direction of the rod assembly 30 as further depicted by the arrows drawn on FIG. 4. In this manner, the sheet material is forced to assume a scalloped configuration as it is drawn through the roller assembly.

Referring to FIG. 6, there is shown an assembly drawing depicting the main components of the rolling machine. As indicated, the roller member 21 may be integrally formed or molded to possess a surface configuration as depicted in FIG. 4.

The shaft 22 associated with the roller member is inserted through bushings 28 and 29. The rod is retained at both ends by pillar blocks 70 and 71. The pillar blocks 70 and 71 may be mounted on a suitable frame to position the top roller in accurate alignment with the bottom rod assembly 30. The exact nature of the coupling of the bottom rod assembly is shown in FIG. 6.

As indicated, a central rod 60 is inserted through the template blocks 34 and 35 at one side and blocks 32 and 33 at the other side. The shaft 60 has an extending projection 61 which eventually is coupled to the gear 45 so that the bottom assembly may be driven directly from the motor 46.

For the sake of simplicity, the exact nature of the frame assembly is omitted from FIG. 6, but it would be obvious to one skilled in the art in how to secure the apparatus as shown in FIGS. 3 and 5.

Referring to FIG. 7, there is shown a typical rod assembly 31. Basically, the rod 31 is of a cylindrical configuration having a main central portion of a uniform diameter. At both ends is a small diameter threaded portion as 70 and 71. The threaded portions are directed through the apertures 75 contained in the template blocks 34 and 35 and blocks 32 and 33. Thus, each rod is secured within the aperture 75 by means of a suitable bolt assembly 36. Thus, each rod located about the central shaft 60 is firmly and rigidly secured. In this manner, the rods 31 cannot rotate during rotation of the member 30.

Due to symmetry of the product to be formed, the rods 31 are located about the shaft 60 with their centers at thirty-six degree intervals, thus specifying ten rods. The top roller section 21 has ten projections 26 and ten recesses 27. Essentially, the roller assembly 21 and the rod assembly 30 may be approximately four inches in diameter, hence having an approximate perimeter of about twenty-five inches. This will enable a metal sheet of a corresponding length to be formed as shown in FIGS. 1 for one complete revolution of the assemblies 21 and 30.

In an operative embodiment, the diameter of each rod as 31 was approximately one inch with an outer diameter of approximately four inches. The upper roller 21 has depressions 27 of a circular configuration adapted to roll over the one inch diameter rod as shown in FIG. 4.

It is understood that the length of the roller 21 and the effective length of the rods could be anywhere from twelve inches to several feet long depending on the width of the sheet material to be formed. In a similar manner, the diameter of the rods as well as the surface configuration of the roller member 21 can be varied to provide formed panels having scalloped configurations of different and various radaii. These aspects as well as different techniques for mounting or driving the rollers should be apparent to those skilled in the art upon review of the above specification and are deemed to be encompassed within the spirit and scope of the claims appended hereto.

We claim:

1. A cold rolling apparatus for forming planar sheet material into panels having scalloped edge configurations, comprising:

(a) a first rotatable roller assembly manifesting a longitudinal cylindrical member having a major surface configuration consisting of continuous arcuate projections and depressions to thus form a gear-like appearance along a major portion of the length of said cylindrical member, said first roller assembly having a first shaft section extending from one end and a second shaft section extending from said other end, said sections located relatively coaxial with the main axis of said cylindrical member, a first gear coupled to said second shaft section of said roller assembly, (b) a second rotatable rod assembly of a length relatively equal to said major portion of said first roller assembly and consisting of a plurality of rods of equal diameter symmetrically positioned about a central reference point to form a circular cross-sectional array with the spacing between said rods selected according to the width of said projections on said roller assembly, said second rod assembly including a central shaft member of a larger diameter than said rods, said rods positioned about said shaft and centrally disposed thereabout to form said circular array, a second gear coupled to said central shaft of said rod assembly, said second rotatable rod assembly including a first and second end plate, each of a circular configuration, having a plurality of equidistant apertures located on a surface thereof with each separate rod directed at one end into one associated aperture of said first plate and at said other end into an associated corresponding aperture in said second plate and rigidly secured in said apertures to prevent rotation of said rods when said assembly is rotated to thus form said circular cross-sectional array with said rods equally spaced about the periphery of said circle formed by said array, said plates each having a central aperture to accommodate said larger diameter central shaft, (c) means for positioning said roller assembly with respect to said rod assembly such that the surfaces of said assemblies are located with respect to one another to enable insertion therebetween of said planar sheet, with said second gear coupled to said central shaft of said rod assembly coacting with said first gear coupled to said roller assembly and operative to drive said first gear to cause said roller assembly to rotate in an opposite direction to said rod assembly, and (d) drive means coupled to said rod assembly for rotating the same with respect to said roller assembly to cause said sheet as emplaced and directed through said assemblies to assume a scalloped edge configuration due to said surface configurations of said first roller and said second rod assemblies.

2. The apparatus according to claim 1 wherein said planar sheet material is fabricated from metal.

3. The apparatus according to claim 1 wherein said plurality of rods comprises ten rods each positioned in said circular array at intervals of thirty-six degrees.

4. The apparatus according to claim 1 further including guide means positioned with respect to said roller and rod assemblies to direct said planar sheet material to a production site after said sheet has assumed said scalloped configuration.

* * * * *